United States Patent [19]

Uhricek et al.

[11] 4,068,352

[45] Jan. 17, 1978

[54] ADJUSTABLE BUCKLE FOR SKI SHOES

[75] Inventors: Ivan Uhricek; Ruedi Schneider, both of Stafa, Switzerland

[73] Assignees: Ivan Uhricek; Schneider, Ruedi, both of Stafa; Jaroslav Vlk, Uster, all of Switzerland

[21] Appl. No.: 784,067

[22] Filed: Apr. 4, 1977

[30] Foreign Application Priority Data

Apr. 5, 1976 Switzerland ..... 4258/76

[51] Int. Cl.[2] ..... A43C 11/00

[52] U.S. Cl. ..... 24/69 SK

[58] Field of Search ..... 24/68 SK, 68 E, 69 SK, 24/69 ST, 70 SK, 70 ST, 71 SK; 36/50, 58.5, 117, 118, 120, 121

[56] References Cited

U.S. PATENT DOCUMENTS

| | | | |
|---|---|---|---|
| 3,182,366 | 5/1965 | Teufel | 24/68 SK |
| 3,295,177 | 1/1967 | Bruckl | 24/70 SK |

FOREIGN PATENT DOCUMENTS

| | | | |
|---|---|---|---|
| 1,356,463 | 2/1964 | France | 24/70 SK |

*Primary Examiner*—Doris L. Troutman
*Attorney, Agent, or Firm*—James E. Nilles

[57] ABSTRACT

An adjustable buckle for a ski shoe or the like and which is infinitely variable without the necessity of threaded bolts or similar adjusting mechanisms. The buckle includes a base plate for being secured to the shoe and which base plate has an upper and lower surface, a locking holder is shiftably mounted on the base plate for bodily shifting in a longitudinal direction along the length of the plate, and the holder is also mounted on the plate whereby it can oscillate relative to the plate and about an axis which is generally transverse to the longitudinal shifting axis of the holder. The holder carries locking means for releasably locking the holder relative to the plate and which locking means engages the opposite surfaces of the base plate. Simply by oscillating the locking holder in one direction or the other about its transverse axis, it can be locked to or released from the base plate. A locking lever is swingably mounted on the holder and a locking member in the form of a bail is swingably mounted on the lever. The locking member engages the corresponding portion such as a hook on the other side of the shoe opening. One aspect of the invention relates to a locking means which comprises a pair of parallel pins extending through and fixed to the locking holder, the pins being spaced apart from one another in the direction in which the locking holder is longitudinally shiftable relative to the base plate. The pins engage the surfaces on opposite sides of the base plate. Another embodiment of the invention is directed to the locking means comprising a transverse slot in the locking holder which slot defines opposite edges that are releasably engageable with opposite surfaces of the base plate.

10 Claims, 3 Drawing Figures

ADJUSTABLE BUCKLE FOR SKI SHOES

BACKGROUND OF THE INVENTION

The present invention concerns an adjustable buckle for ski shoes, with a base plate, and, shiftably arranged on the base plate, a locking holder on which a locking lever is swingably arranged.

Heretofore, no buckles for ski shoes of this type have become known that are infinitely or steplessly adjustable without threaded bolts or the like.

SUMMARY OF THE INVENTION

The object of the present invention resides in the creation of a buckle for ski shoes that is finely or steplessly adjustable my means of manual force.

The present invention provides an adjustable buckle for ski shoes or the like that is capable of infinitely varying the adjustment of the buckle. The buckle provided by the present invention includes a base plate for being secured to the shoe and a locking holder shiftably mounted on the base plate in a longitudinal direction relative to its length and also mounted generally about a transverse axis for oscillating movement relative to the base plate. Means are provided on the locking holder for releasably engaging opposite surfaces of the base plate to thereby lock the holder relative to the base plate or to a release position in respect thereto. In one form of the invention, the locking means includes a pair of transversely extending pins secured to the locking holder and which are releasably engageable with opposite sides of the base plate or which are released therefrom upon oscillation of the locking holder. In this form of the invention, the holder is mounted to the base plate by being bodily slidable in a longitudinal slot in the base plate and is also mounted so that the holder can oscillate to a limited degree within the slot.

In a modification of the invention, the locking holder has a transverse slot extending therethrough and in which the base plate is mounted. The slot defines opposite locking edges which are selectively and releasably engageable with opposite surfaces of the base plate. When the locking holder is manually depressed to one position, the locking holder is released from the base plate. Otherwise, the locking holder is spring biased to another position in which the transverse edges defined by its slot grip the opposite sides of the base plate for locking the holder to the plate.

A locking lever is swingably mounted to the locking holder in either embodiment and a locking member or bail is swingably mounted on the locking lever to engage a hook or other bail receiving member on the shoe.

These and other objects and advantages of the present invention will appear hereinafter as this disclosure progresses, reference being made to the accompanying drawings.

DESCRIPTION OF A PREFERRED EMBODIMENT

Figure 1:
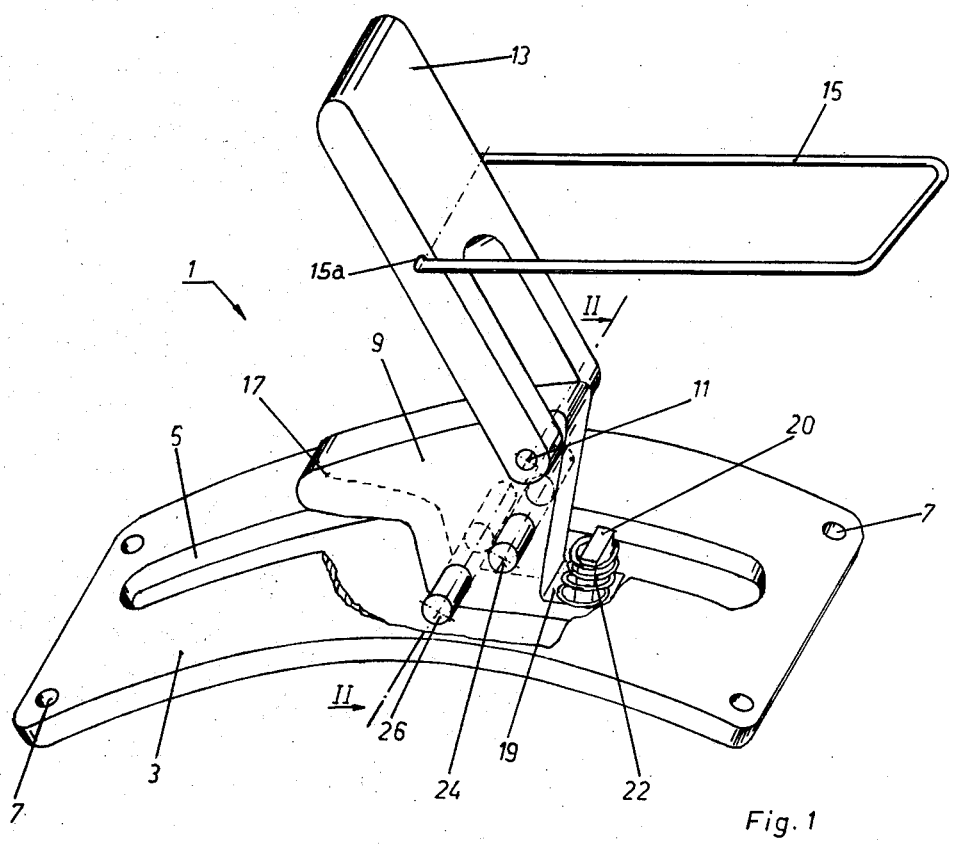
FIG. 1 is a perspective view of an adjustable buckle providing for securement to a ski shoe, with parts broken away.

The ski shoe buckle 1 shown in FIG. 1 has a base plate 3 provided with an elongated slot 5 as well as with four holes 7, one at each corner of the plate 3. The base plate 3, and its buckle 1 is secured to a ski shoe by means of rivets or screws (not shown) extending through holes 7. The buckle 1 also has a locking holder 9 with a locking lever 13 swingably arranged on its upper portion by means of a pin 11. A locking member in the form of a bail 15 is swingably supported at **15*a* intermediate the length of the lever 13. The free loop of bail 15** serves as the grip to the corresponding hook (not shown) fastened to the ski shoe. The upper and/or the lower surfaces of the base plate can be grooved, knurled, toothed or simply roughened.

Figure 2:
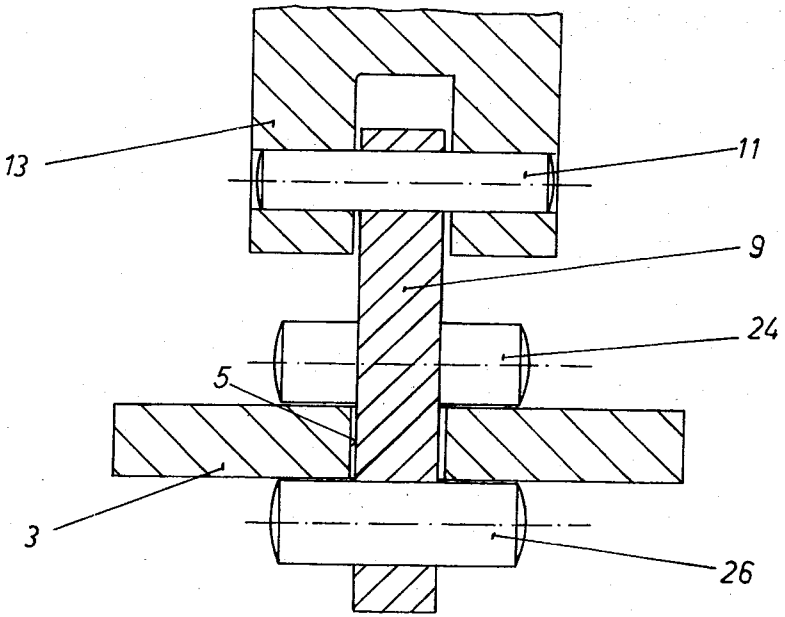
FIG. 2 is a sectional view taken along line II—II of FIG. 1 with a base plate extending in one plane.

One end of the locking holder 9 is provided with a nose 17 and at its other with a generally horizontal platform 19 located at the underside of the base plate 3. This platform 19 comprises an upstanding guide tang 20, the free side flanks of which project to the slot 5 and are guided thereby. A coiled spring 22 is located around the tang 20 and bears against the underside of the base plate 3 and biases the locking holder 9 in the clockwise direction (as viewed generally in FIG. 1). As shown in FIG. 2, the locking holder 9 is further provided with an upper pin 24 passing transversely through it and also with a lower pin 26, which pins 24, 26 lie parallel to one another but are nevertheless also offset from one another vertically relative to the slot axis, that is, to the displacement direction. The upper pin 24 lies at the upper side of the base plate 3, the lower pin 26 at its underside. Pins 24 and 26 form releasable locking means.

Subject to the coil spring 22, the pin 24 is pressed against the upper side of the base plate and the pin 26 against its underside, so that, corresponding to the strength of the spring 22 and to the lever arm, a connection exists which is force-locking, sometimes partly form-locking, that prevents the locking holder 9 from being freely displaced in the slot 5.

For adjusting the buckle, or for shifting the locking holder 9 relative to the base plate 3, a force is exerted from above and upon the nose 17, for example by means of the skiers thumb, which force swings the locking holder 9 in the counter-clockwise direction (FIG. 1), in such a manner that the pins 24 and 26 are lifted off their respective supporting surfaces of the base plate 3, and thereby the force-locking, sometimes partly form-locking connection with the base plate 3 is released. The locking holder 9 can then be arbitrarily slid in the slot 5 to the desired position. Upon release of the nose 17, the coil spring 22 again exerts the force-locking, sometimes partly form-locking connection between the pins 24, 26 and the base plate 3 in the above described manner.

To connect the buckle, the locking bail 15 is engaged into the corresponding hook (not shown), and the locking lever 13, swinging around the axis of the pin 11, is actuated downwardly in the counter-clockwise direction (FIG. 1) until it finds itself in the overlapped position underneath the nose 17 of the self-locking position. The reaction force acting upon the locking holder 9, corresponding to the clamping force on the locking bail 15, exerts upon the locking holder 9 a clockwise-acting turning moment relative to the pins 24, 26 (which form releasable locking means) so that it tends to swing the locking holder 9 with corespondingly large force in the sliding direction and thereby produces a corresponding force-locking, sometimes partly form-locking connection with the base plate 3 in the previously explained manner.

In this manner, it is possible by means of a simple manipulation, through manual pressure on the nose 17, to adjust the buckle due to the oscillating movement of the holder relative to the base plate, and finally secure the connection between the hook (not shown) and the locking bail 15.

It is naturally within the principles, and possible, to provide the base plate with an attachment in band form for guiding the pins 24 and 26, which would prevent a seizing against the base plate. This, however, does not alter the basic principle of the force-locking, sometimes partially form-locking connection of the movable and the stationary parts of a buckle of this type for ski shoes.

MODIFICATION

Figure 3:
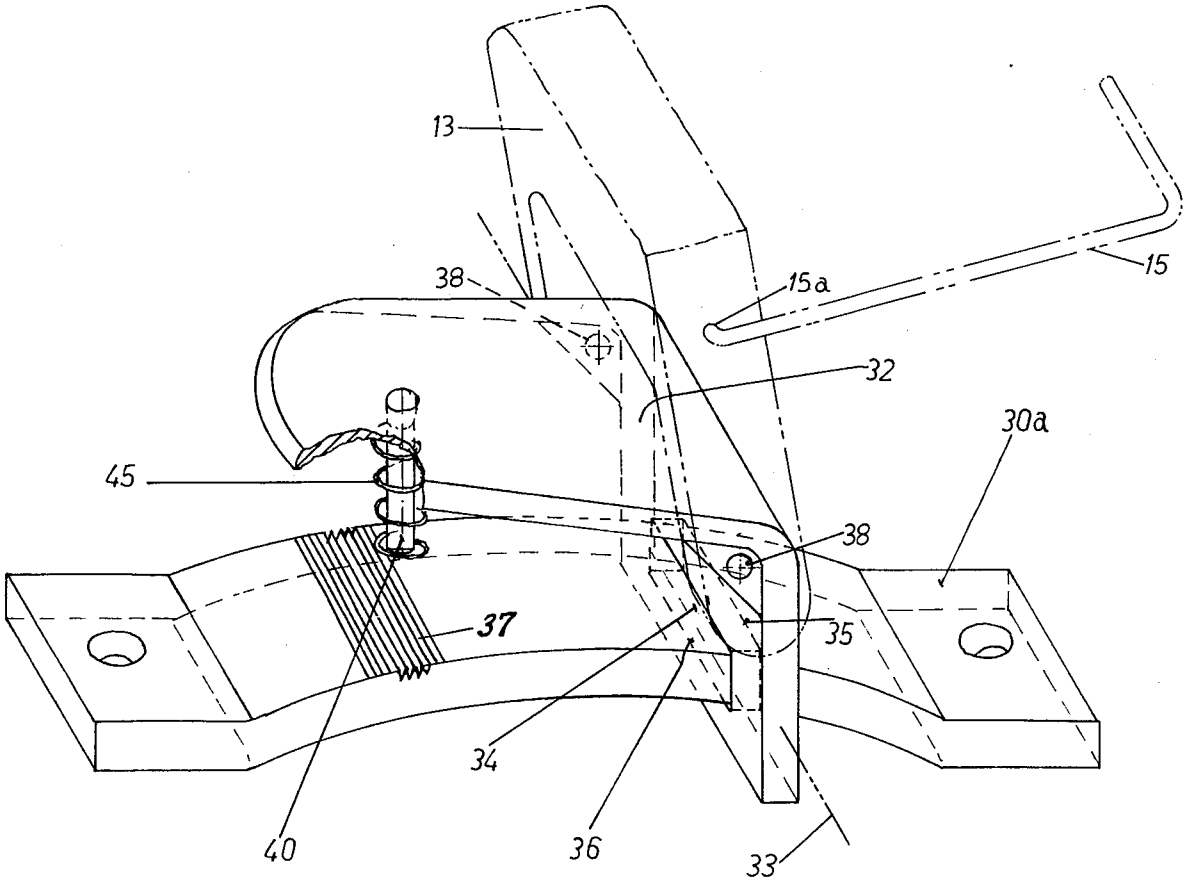
FIG. 3 is a variant of the example according to FIG. 1.

FIG. 3 shows a further version of a buckle in a construction analogous to the embodiment of FIG. 1. This modification also has a base plate 30*a* with a locking holder 32 having a generally rectangular, transverse slot 34 through which the base plate 30*a* (of rectangular cross-section) projects. The slot 34 has an upper edge 35 and a diagonal underlying lower edge 36. Laterally, further openings 38 are provided for the attachment of the locking lever 13, analogously to the embodiment according to FIG. 1. On the front portion of the tongue shaped locking holder 32, a pin 40 is fixed and having a coil spring 45 therearound which is formed as a compression spring. The locking holder 32 is swingable about an axis (indicated for example at 33) that is transverse and at right angles to an axis of adjustment along the base plate 30*a*. The plate 30*a* can be provided with serrations or teeth 37 transversely across its upper surface. The spring 45 attempts to swing the locking holder 32 about this axis in the clockwise direction (FIG. 3) in such a manner that the upper edge 35 and the lower edge 36 are pressed against the upper and lower surfaces, respectively, of the base plate 30*a*, which, instead of having serrations 37, can be grooved, knurled or otherwise have a roughening, in such a manner that there is produced a force-locking, sometimes partly form-locking connection between the locking holder 32 and the plate 30*a*. It is also possible to roughen, tooth or the like the lower surface or both surfaces of the base plate 30*a*.

In order to shift the locking holder 32 along the base plate 30*a*, the tongue portion of the locking holder 32 is pressed towards the base plate 30*a* against the force of the spring 45, by means of the skier's thumb, for example, so that the upper edge 35 and the lower edge 36 of the slot 34 are freed from their force-lock, sometimes partly form-lock, and the locking holder 32 can be moved along the base plate 30*a*.

In this manner, it is possible to adjust the locking lever 13 with the locking bail and to achieve the desired clamping size for the locking of the buckle. The adjustment capability if almost infinitely variable, i.e., quasi-stepless.

RECAPITULATION

The present invention provides an extremely simple buckle which is both economical to manufacture and which is particularly efficient and easy to operate in performing the function for which it was designed.

The buckle provided by the present invention has a locking member that is bodily slideable in a longitudinal direction on the base plate and which is also oscillatable about a transverse axis in respect to the base plate. The locking holder is spring biased to the locking position and can be easily oscillated to the unlocked position simply by depressing one end of the locking holder. The locking holder carries locking means for releasably engaging opposite surfaces of the base plate. In one form of the invention, the locking means comprises the transverse, parallel pins which are spaced apart in a longitudinal direction, one being located on either side of the base plate for engagement with its respective side. In the other form of the invention, the locking means comprises a transverse slot through the locking holder and which defines locking edges, one adjacent either side of the base plate and for releasably but lockingly engaging their respective sides of the base plate.

Thus, the buckle provided by the present invention provides a locking holder that can be quickly released and bodily shifted along the base plate to anyone of an infinite number of positions in respect thereto. They then lock the holder in the selected position, it is only necessary to release the holder as being the operator removing his thumb from the depressing position and when that is done, the holder is biased to the locking position where its locking means abuts against and locks on opposite sides of the base plate.

We claim:

1. An adjustable buckle for a ski shoe or the like and comprising, a base plate having means for being secured to said shoe, said plate having upper and lower surfaces, a locking holder having a shiftable connection with said base plate for shifting in a longitudinal direction relative to and on said base plate, a locking lever swingably mounted on said holder, a locking member swingably secured to said lever, said locking holder also being oscillatingly mounted on and relative to said plate about an axis which is transverse to said longitudinal shifting direction of said holder, and locking means on said holder for releasably and simultaneously engaging said upper and lower surfaces of said base plate, whereby said holder is selectively releasably connected to said base plate by said locking means.

2. The buckle set forth in claim 1 further characterized in that the shiftable connection includes a longitudinal slot extending in and through the base plate, and said locking holder extends through said slot for longitudinal shifting therein and relative to the base plate.

3. The adjusting buckle set forth in claim 2 further characterized in that said locking means comprises a pair of pins fixed to and extending through said locking holder and in a transverse direction, said pins being spaced apart from one another in the said longitudinal direction, said pins also being disposed one on each side of said base plate for releasable locking engagement with their respective sides of the base plate.

4. The buckle set forth in claim 3 further characterized in that the shiftable connection includes a longitudinal slot extending in and through the base plate, and said locking holder extends through said slot for longitudinal shifting therein and relative to the base plate.

5. The buckle set forth in claim 1 further characterized in that said shiftable connection includes a transverse slot in said holder and said base plate extends through said slot whereby said holder can be bodily shifted in a longitudinal direction along said base plate.

6. The buckle set forth in claim 5 further characterized in that said locking means is comprised of a pair of edges defined by said slot, one on each side of said base plate and for releaseable locking engagement with their respective side of said base plate.

7. The buckle set forth in claim 1 further characterized in that at least one of said surfaces of said base plate has serrations or the like along at least one portion thereof.

8. The buckle defined in claim 5 further characterized in that at least one of said surfaces of said base plate has serrations or the like at least on a portion thereof.

9. The buckle set forth in claim 1 including spring means acting between said base plate and said locking holder for biasing the latter to a locking position.

10. The buckle set forth in claim 5 including spring means acting between said base plate and said locking holder for biasing the latter to a locking position.

* * * * *